US005605467A

United States Patent [19]

Beck et al.

[11] Patent Number: 5,605,467

[45] Date of Patent: Feb. 25, 1997

[54] COVER FOR BATTERY COMPARTMENT AND COMMUNICATIONS PORT

[75] Inventors: H. Richard Beck, Moon Township; Kenneth M. Fischer, Union Township, both of Pa.

[73] Assignee: Eaton Corporation, Cleveland, Ohio

[21] Appl. No.: 375,454

[22] Filed: Jan. 19, 1995

[51] Int. Cl.[6] ..... H01R 13/44

[52] U.S. Cl. ..... 439/148; 439/301

[58] Field of Search ..... 439/138, 148, 439/135, 142, 301

[56] References Cited

U.S. PATENT DOCUMENTS

| | | | |
|---|---|---|---|
| 3,699,498 | 10/1972 | Hardesty et al. | 339/64 M |
| 4,311,883 | 1/1982 | Kidney | 179/189 R |
| 4,426,121 | 1/1984 | Stoewe et al. | 339/38 |
| 4,656,444 | 4/1987 | McKee et al. | 335/16 |
| 4,679,018 | 7/1987 | McKee et al. | 335/167 |
| 4,827,369 | 5/1989 | Saletta et al. | 361/96 |
| 4,870,531 | 9/1989 | Danek | 361/93 |
| 4,870,840 | 10/1989 | Klein | 70/57 |
| 4,911,646 | 3/1990 | Marson et al. | 439/133 |
| 4,963,846 | 10/1990 | Grunert et al. | 335/42 |
| 4,964,284 | 10/1990 | McDaid | 70/14 |
| 5,270,898 | 12/1993 | Elms et al. | 361/96 |
| 5,305,380 | 4/1994 | Hileman et al. | 379/445 |
| 5,315,531 | 5/1994 | Oravetz et al. | 364/550 |
| 5,340,324 | 8/1994 | Fields et al. | 439/133 |
| 5,429,522 | 7/1995 | Noschese et al. | 439/133 |

*Primary Examiner*—Neil Abrams
*Assistant Examiner*—Eugene G. Byrd
*Attorney, Agent, or Firm*—Martin J. Moran

[57] ABSTRACT

A cover for a communications port and an aperture at a surface of an electrical switching device includes a cover mechanism for covering at least the communications port and the aperture; and a plug having a proximate end attached to the cover mechanism and having a distal end for insertion within a recess of the communications port. Alternatively, an electrical switching device comprises separable contacts; a housing for the separable contacts including a surface having an aperture and a communications port with a recess; a cover mechanism for covering at least the communications port and the aperture; and a plug having a proximate end attached to the cover mechanism and having a distal end for insertion within the recess of the communications port.

9 Claims, 4 Drawing Sheets

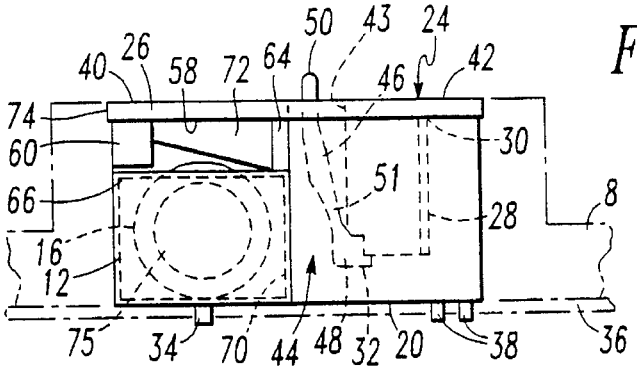
FIG. 2
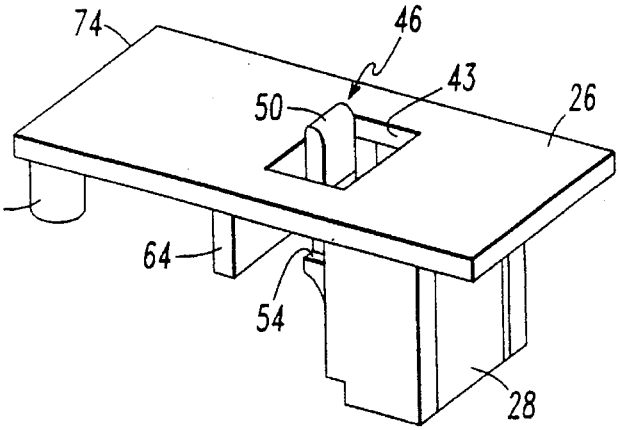
FIG. 3
FIG. 4
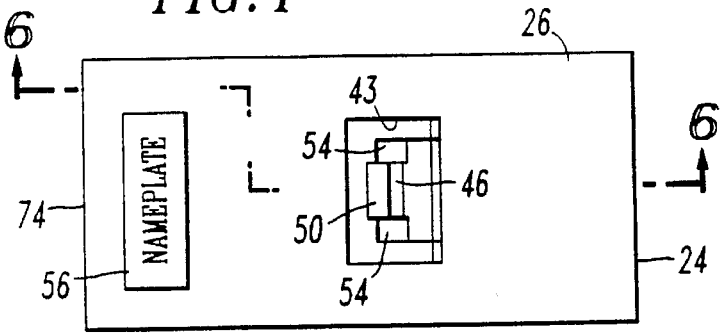
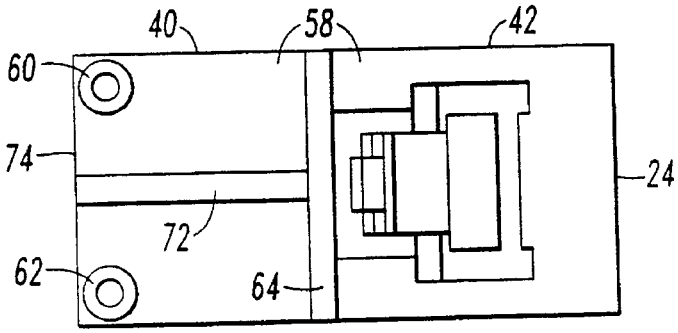
FIG. 5

COVER FOR BATTERY COMPARTMENT AND COMMUNICATIONS PORT

BACKGROUND OF THE INVENTION

1. Field of the Invention

This invention relates to a cover for a communications port, and more particularly to a protective cover for a communications jack and a battery compartment. The invention also relates to an electrical switching device having a communications port, a battery compartment, and a cover for the communications port and battery compartment.

2. Background of Information

Electrical switching devices include, for example, circuit switching devices, circuit breakers and circuit interrupters. Circuit breakers, which are well-known in the art, are generally used to protect electrical circuitry from damage due to an overcurrent condition, such as an overload fault or a relatively high level short circuit condition. Molded case circuit breakers, for example, include at least one pair of separable contacts which are operated either manually by way of a handle disposed on the outside of the case or automatically by way of an internal digital trip unit in response to an overcurrent condition. Examples of molded case circuit breakers are disclosed in U.S. Pat. No. 4,656,444; 4,679,018; 4,827,369; and 4,963,846.

Circuit interrupters are electrically operated switches used for controlling motors and other types of electrical loads. Circuit interrupters include, for example, contactors, motor starters, motor controllers and other electromechanical switching devices. Electromagnetic contactors, for example, include a plurality of movable electrical contacts which are brought into contact with a plurality of fixed electrical contacts to close the contactor. The movable electrical contacts are separated from the fixed contacts to open the contactor. A contactor with an overload protection relay system is called a motor starter. The purpose of the overload relay is to estimate the heat produced in the motor by line current and "trip" or stop the motor if the retained heat exceeds an acceptable level.

Some electrical switching devices include a communications link for communication with a remote monitoring unit or a local programming device. For example, as described in U.S. Pat. No. 5,315,531 which is hereby incorporated by reference, individual energy monitoring units for associated circuit breakers are remotely linked to a central monitoring unit, such as a personal computer (PC), through a communications system. The communications system utilizes a simple two wire synchronous communication line which is daisy chained to the several energy monitoring units and the PC. The PC digitally addresses each of the energy monitoring units in a master-slave relationship for the purpose of gathering the data generated by each of such units for central processing and allocating energy consumption billing for the loads of the associated circuit breakers.

Otherwise, the circuitry of the energy monitoring unit may be integrated with the associated circuit breaker. The local programming device utilizes the same or a similar communications link as the remote monitoring unit in order to, for example, monitor energy consumption, determine the closed/opened/trip status of the circuit breaker, or modify pickup current factors and time factors of the digital trip unit.

The energy monitoring circuitry includes a custom Sure Plus integrated circuit chip (IC) described in U.S. Pat. No. 5,270,898 which is hereby incorporated by reference. This IC includes an analog to digital converter, a microprocessor and a communications interface by which the calculated energy consumed by the associated load is provided to the communications link through a communications port connector in the housing of the circuit breaker.

The digital trip unit is used with various frame sizes of circuit breakers. In addition, each of the frame sizes of circuit breakers with which the digital trip unit is compatible can be used to protect an electrical system in which the maximum continuous current permitted is less than or equal to the maximum continuous current permitted by the frame. In order to provide this information to the digital trip unit, a suitable, removable rating plug can be plugged into the digital trip unit. The rating plug contains a number of resistors which are keyed to the frame size, and which set the maximum or rated current for the particular installation. This rated current can be the maximum current allowed by the frame size or some smaller value.

An example of a circuit breaker with a rating plug is disclosed in U.S. Pat. No. 4,827,369 which is hereby incorporated by reference. The rating plug, as disclosed by this patent, also contains a battery which provides a three volt source of power. The digital trip unit is powered by current from the power circuit which is protected by the circuit breaker. When the circuit breaker trips and the current therethrough is interrupted, the power to the circuit breaker's microprocessor is normally interrupted. The three volt power provided by the battery of the rating plug is applied to a latch which stores trip status information and drives light emitting diodes (LEDs). In this manner, the LEDs remain energized following a trip and indicate the cause thereof.

U.S. Pat. No. 3,699,498 discloses a plug having a resiliently cantilevered latch which is mateable with miniature jacks in the handset and base of a telephone.

U.S. Pat. Nos. 4,311,883; 4,870,840; 4,964,284; 5,305,380; and 5,340,324 each disclose a dummy plug for a telephone socket or jack. In particular, U.S. Pat. No. 4,311,883 discloses a lock for a conventional telephone jack including a case and a plug having a cantilevered leaf spring. The leaf spring has corners outside the case that latch behind corners of the telephone jack socket opening when the plug is inserted therein. An unlocking mechanism is operable by a removable key to rotate a bolt within the case and depress the leaf spring therein in order to clear the corners of the socket opening and remove the plug therefrom.

U.S. Pat. No. 4,870,840 discloses a device for locking and unlocking an unused telephone socket opening. The device includes a plug which is attached to a casing of a sliding bolt lock. A sliding wedge is positioned under a leaf spring of the plug in order to prevent the plug from being removed from the socket opening whenever the wedge is locked in position by the bolt lock.

U.S. Pat. No. 4,964,284 discloses a device for locking and unlocking an unused telephone socket opening. The device includes a plug with a member which is movable by a barrel lock to engage or disengage a shoulder within the socket opening.

U.S. Pat. Nos. 5,305,380 and 5,340,324 similarly disclose locking plugs which are lockable within a conventional telephone socket opening and which are removable by a specialized tool or key.

U.S. Pat. No. 4,426,121 discloses a plug for masking switching contacts such as the terminal strips of telecommunication devices.

Whenever the communications port connector of the circuit breaker's communication link is unused and, hence, uncovered, such connector is subjected to dust and dirt from the surrounding industrial environment. Furthermore, the exposed electrical conductors of the communications connector may be subject to extreme voltage caused by electrostatic discharge (ESD) from, for example, maintenance personnel. With the exposed communications connector, such ESD may cause misoperation or damage to the communications link and/or the circuit breaker.

The battery for powering the status latch and external status LEDs of the circuit breaker may be held, separate from the rating plug, within a battery compartment in the face of the circuit breaker. Hence, following a trip, the rating plug may be removed and/or modified without disabling the status latch which continues to be powered by the battery. In the same manner as the exposed communications connector, the exposed battery compartment and battery are also subject to dust, dirt and ESD which may similarly cause damage or misoperation of the circuit breaker.

SUMMARY OF THE INVENTION

The present invention is directed to a cover for a communications port and an aperture at a surface of an electrical switching device. The cover includes a cover mechanism for covering at least the communications port and the aperture; and a plug mechanism having a proximate end attached to the cover mechanism and having a distal end for insertion within a recess of the communications port.

As another aspect of the invention, an electrical switching device comprises a separable contact mechanism; a housing for the separable contact mechanism including a surface having an aperture and a communications port with a recess; a cover mechanism for covering at least the communications port and the aperture; and a plug mechanism having a proximate end attached to the cover mechanism and having a distal end for insertion within the recess of the communications port.

BRIEF DESCRIPTION OF THE DRAWINGS

A full understanding of the invention can be gained from the following description of the preferred embodiment when read in conjunction with the accompanying drawings in which:

FIG. 2 is a side view of the modular connector, the battery compartment, and the connector cover in accordance with the embodiment of FIG. 1;

FIG. 3 is an isometric view of the connector cover in accordance with the embodiment of FIG. 1;

FIG. 4 is a plan view of the connector cover of FIG. 3;

FIG. 5 is a bottom view of the connector cover of FIG. 3;

DESCRIPTION OF THE PREFERRED EMBODIMENT

Figure 1:
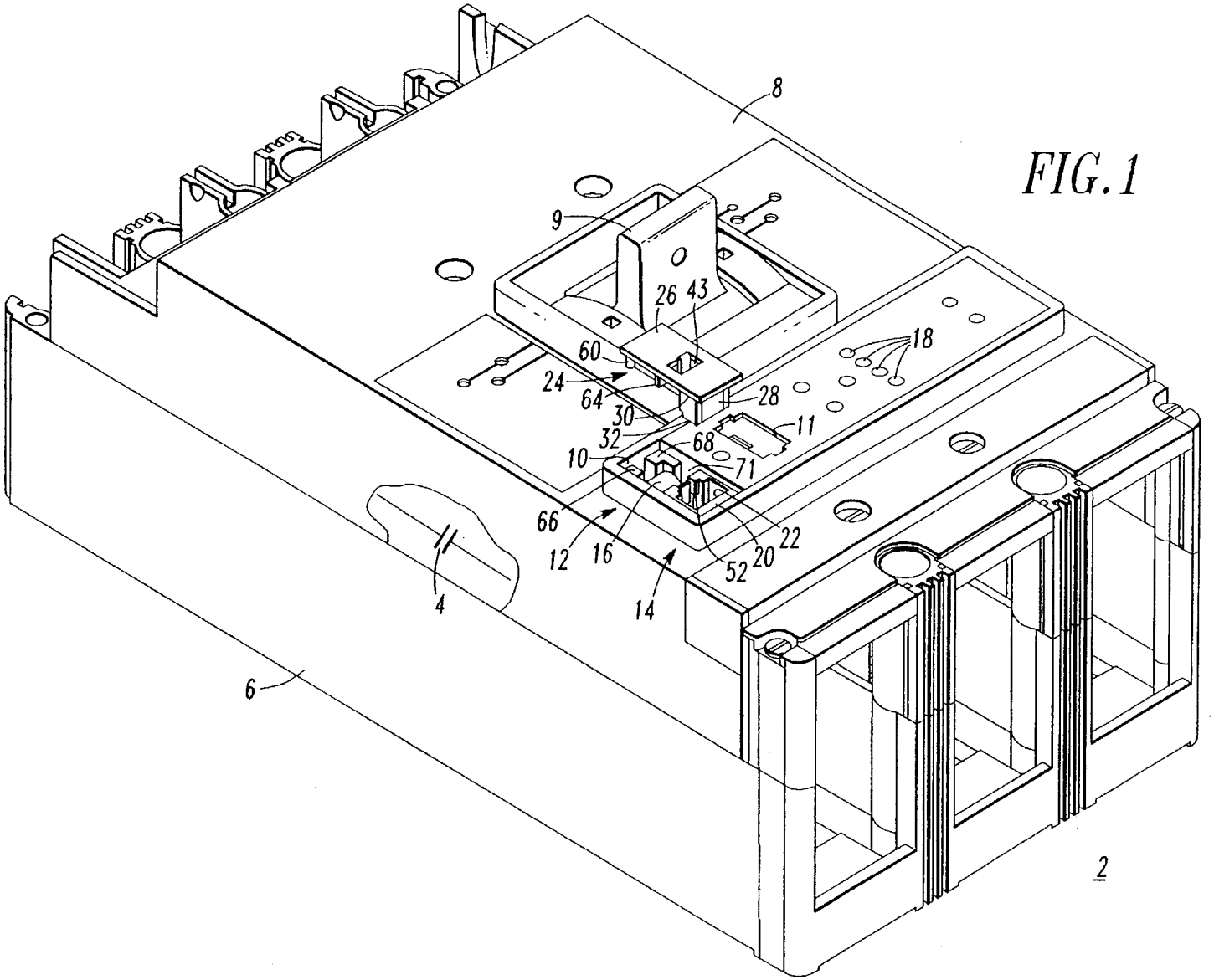
FIG. 1 is an exploded isometric view, with some parts cut away, of a circuit breaker including a modular connector, a compartment for a battery, and a connector cover for the modular connector and the battery compartment in accordance with an embodiment of the invention.

Referring to FIG. 1, an isometric view of a circuit breaker 2 is illustrated. The present invention, however, is applicable to a wide variety of electrical switching devices such as, for example, circuit switching devices, circuit interrupters, contactors, motor starters, motor controllers, and other electromechanical switching devices. The circuit breaker 2 includes a plurality of separable contacts 4 (only one is schematically shown) housed within a molded case 6. The molded case 6 has a front face 8 with a handle 9 and two apertures 10,11. The circuit breaker 2 also includes a battery compartment 12, which is accessible through the aperture 10, and a communications port 14 on the front face 8. The communications port 14 facilitates connection of a hand held programming unit (not shown) with the circuit breaker 2. The circuit breaker 2 also includes a rating plug (not shown) which is accessible through the aperture 11 on the front face 8.

The battery compartment 12 holds a battery 16 which powers an internal latch (not shown) that drives a plurality of light emitting diodes (LEDs) 18 on the front face 8. The LEDs 18 indicate, for example, the reason for a trip of the circuit breaker 2. The communications port 14 includes a modular connector 20 such as, for example, a telecommunications jack having eight conductors or pins, although any modular connector having any number of conductors may be used. The connector 20 has a recess 22 wherein the conductors (not shown) of the connector 20 are mounted.

The circuit breaker 2 also includes a connector cover 24 for the modular connector 20 and the battery compartment 12. The connector cover 24 includes a cover 26 and a plug 28. Preferably, the connector cover 24 is made of polycarbonate (e.g., "LEXAN", etc.), although any molded plastic (e.g., "VALOX", "RYNITE", etc.) may be utilized. As explained in greater detail below with FIG. 2, the connector cover 24 covers the communications port 14 and the aperture 10 including the battery compartment 12. The plug 28 has one end 30 attached to the cover 26 and another end 32 for insertion within the recess 22 of the connector 20 of the communications port 14.

FIG. 2 is a side view of the modular connector 20, the battery compartment 12 for the battery 16 (shown in phantom line drawing), and the connector cover 24. The battery compartment 12 has two leads 34 (only one is shown) which are connected to an internal printed circuit board (PCB) 36 (shown in phantom line drawing) of the circuit breaker 2 of FIG. 1. The exemplary connector 20 has eight leads 38 (only two are shown) which are also connected to the PCB 36. The cover 26 of the connector cover 24 has a portion 40 which covers the aperture 10 of FIG. 1 and the battery compartment 12 and, also, has a portion 42 which covers the connector 20.

Referring to FIGS. 1–4, the connector cover 24 has an opening 43 in the cover 26 and a latch mechanism 44 (as shown in phantom line drawing in FIG. 2) with a single leaf cantilevered spring 46. The cantilevered spring 46 has a fixed end 48 cantilevered from the end 32 of the plug 28, a free end 50 which protrudes through the opening 43 of the cover 26, and a reduced cross section portion 51 between the ends 48,50. The opening 43 is in the portion 42 of the cover 26. The plug 28 is inserted into the recess 22 of the modular connector 20 of FIG. 1, in order to insulate the internal conductors (not shown) of the connector 20 from ESD and, further, to isolate the connector 20 from contaminants such as dirt and dust. After insertion of the plug 28 into the recess 22, the free end 50 of the cantilevered spring 46 remains accessible through the opening 43 of the cover 26.

As shown in FIG. 1, the recess 22 of the communications port 14 has a pair of shoulders 52 (only one is shown). The cantilevered spring 46 (as shown in FIG. 4) has a pair of detents 54 which are insertable into the recess 22 in order to engage the corresponding shoulders 52 of the recess 22 and secure the connector cover 24 to the modular connector 20. The connector cover 24 is installed by inserting the end 32 of the plug 28 into the recess 22 of the connector 20. In this manner, the detents 54 snap fit and are latched by the corresponding shoulders 52 of the recess 22. The connector cover 24 is unlatched by applying finger pressure against the free end 50 of the cantilevered spring 46 (e.g., toward the bottom fight of FIG. 3) and moving the cantilevered spring 46 toward the plug 28. In turn, the detents 54 are disengaged from the corresponding shoulders 52 of the recess 22 and the plug 28 is withdrawn from the recess 22. As shown in FIG. 4, the upper surface of the cover 26 has a nameplate 56 which includes, for example, identification of the requirements of the covered battery 16 of FIG. 1, and the location of the communications port 14 of FIG. 1.

Referring to FIGS. 1, 2 and 5, the bottom 58 of the connector cover 24 includes two posts 60,62 and a transverse wall 64 in the portion 40 of the cover 26. The battery compartment 12 includes two corners 66,68 opposite from a wall 70 which collectively form a generally rectangular opening 71 for the battery 16. Whenever the connector cover 24 is installed, the posts 60,62 rest on top of the corners 66,68, respectively, and the transverse wall 64 rests on top of the wall 70 of the battery compartment 12. In this manner, the walls 64,70 and the cover 26 protect the battery compartment 12 and the battery 16 from dust, dirt and ESD.

The bottom 58 of the connector cover 24 also includes a longitudinal flange 72. The exemplary flange 72 is perpendicularly connected beneath the portion 40 of the cover 26 and is also perpendicularly connected to the transverse wall 64 of the cover 26. The transverse wall 64 and the flange 72, also, prevent warpage of the cover 26. As shown in FIG. 2, the flange 72 angles from the bottom of the transverse will 64 to the end 74 of the portion 40 of the cover 26. The terminals (not shown) of the battery compartment 12 generally provide suitable surface area for contacting the terminals 75 (shown in phantom line drawing) on the ends of the battery 16. The flange 72 of the connector cover 24 provides a surface contacting the upper surface of the battery 16 and facilitates retaining the battery 16 in place within the compartment 12 whenever the plug 28 of the connector cover 24 is fully inserted into the recess 22 of the communications port 14 and the battery compartment 12 is fully covered by the cover 26.

Figure 6:
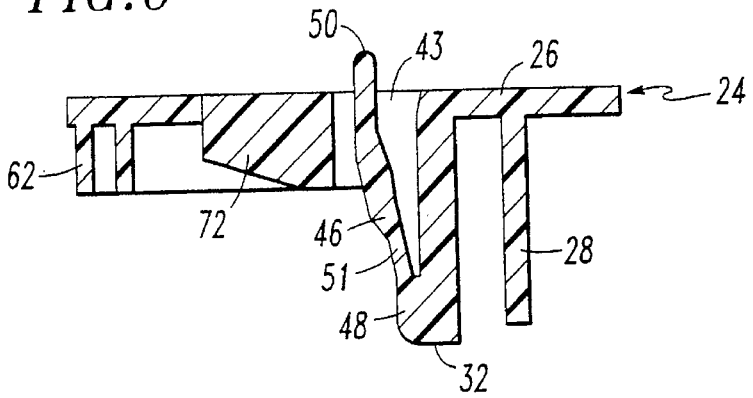
FIG. 6 is a cross sectional view along lines 6—6 of FIG. 4.

FIG. 6 illustrates the connector cover 24 in cross section. As discussed above, the fixed end 48 of the cantilevered spring 46 is cantilevered from the end 32 of the plug 28. The free end 50 of the cantilevered spring 46 protrudes through the opening 43 of the cover 26. The plug 28, the post 60 (shown in FIG. 5), and the post 62 each have a hollow core which facilitates molding of the cover 24.

Figure 7:
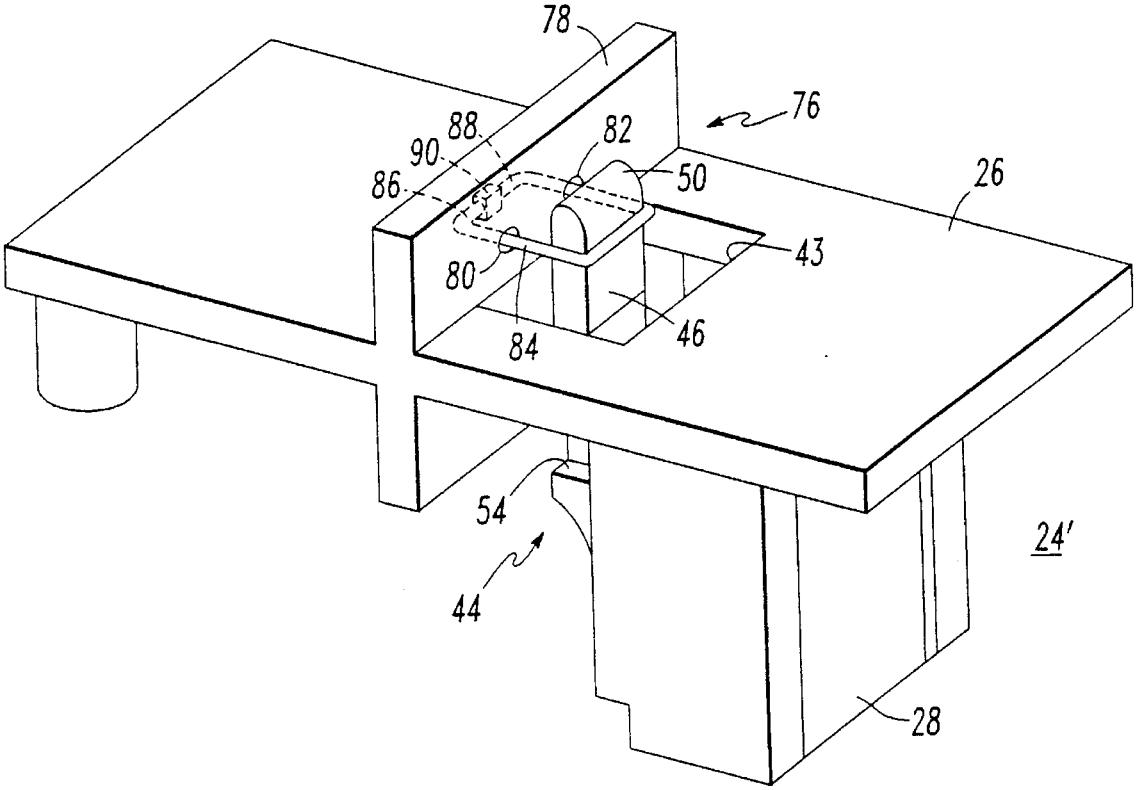
FIG. 7 is an isometric view of a connector cover including a lock wire in accordance with an alternative embodiment of the invention.

Referring to FIG. 7, an alternative connector cover 24' is illustrated. The cover 24' includes a frangible locking mechanism 76 for holding the latch mechanism 44 away from the plug 28. In this manner, the detents 54 (best shown in FIG. 4) of the cantilevered spring 46 are prevented from disengaging the corresponding shoulders 52 of the recess 22 of the communications port 14 of FIG. 1. The frangible locking mechanism 76, which is adjacent the opening 43 of the cover 26, includes a transverse wall 78 having two holes 80,82, and a lock wire 84. The wire 84 passes around the cantilevered spring 46 and through the two holes 80,82 of the transverse wall 78. Two ends 86,88 (shown in phantom line drawing) of the wire 84 are secured together on the opposite side of the transverse wall 78 in order to tighten the wire 84 around the cantilevered spring 46 and hold the cantilevered spring 46 away from the plug 28.

Preferably, the ends 86,88 of the wire 84 are secured within a lead seal 90 (shown in phantom line drawing), such as an electrician's sealing device, which provides a visual confirmation that the wire 84 is unbroken and, hence, that the detents 54 remain engaged with the corresponding shoulders 52 of the recess 22 of the communications port 14 of the circuit breaker 2 of FIG. 1. This ensures that there has been no unauthorized use of the communications port 14. On the other hand, for authorized use of the communications port 14, the wire 84 is broken in order to permit the free end 50 of the cantilevered spring 46 to be moved toward the plug 28. In turn, the detents 54 of the cantilevered spring 46 are disengaged from the corresponding shoulders 52 of the recess 22. Subsequently, after authorized use of the communications port 14, the ends 86,88 of the wire 84 are again secured within a replacement lead seal 90.

Figure 8:
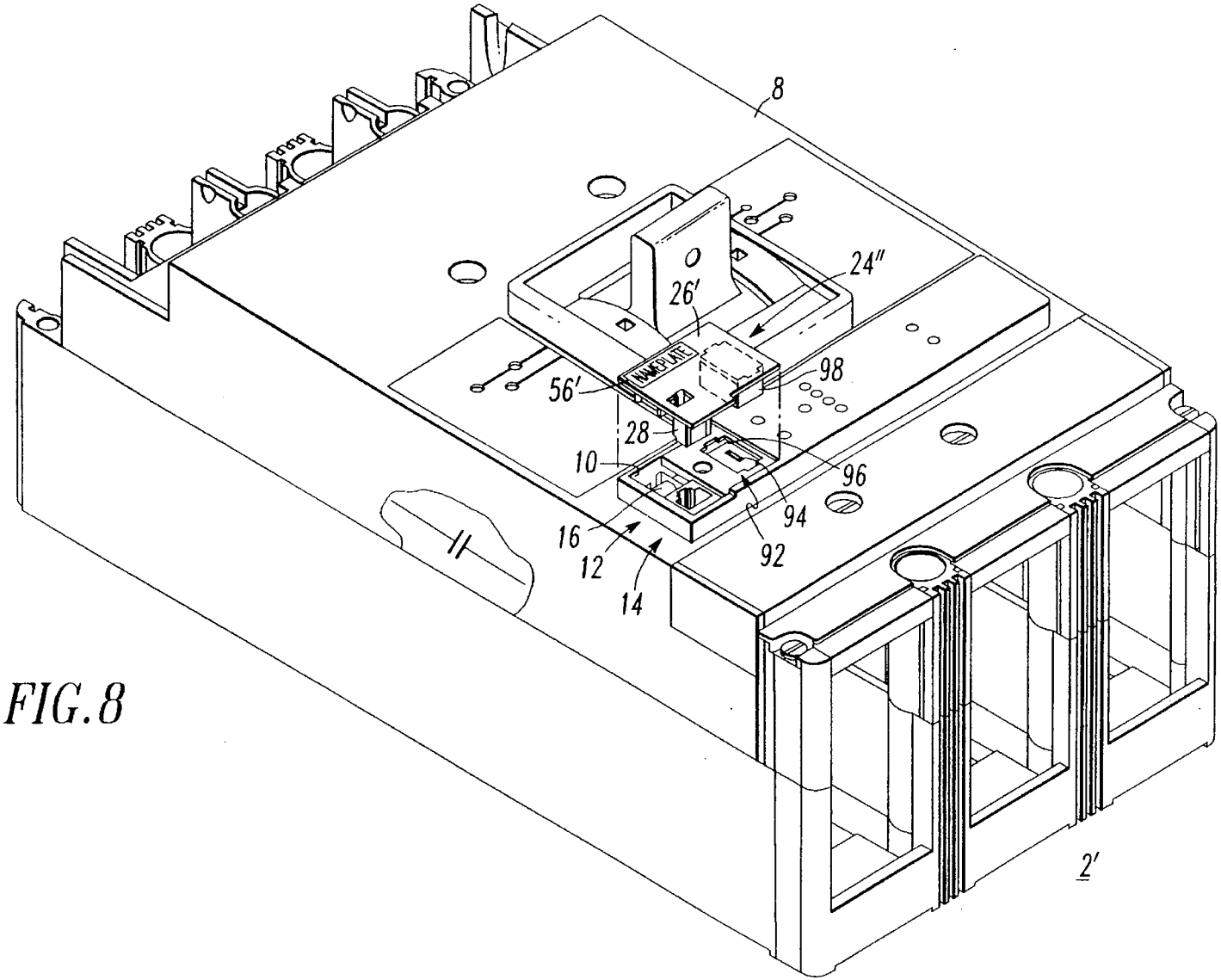
FIG. 8 is an exploded isometric view, with some parts cut away, of a circuit breaker including a modular connector, compartments for a battery and a rating plug, and a connector cover for such compartments in accordance with another alternative embodiment of the invention.

Referring to FIG. 8, an alternative connector cover 24" is illustrated with a corresponding exemplary circuit breaker 2'. The connector cover 24" and the circuit breaker 2' are generally similar to the connector cover 24 and circuit breaker 2, respectively, of FIG. 1. The connector cover 24" includes a cover 26' and the plug 28. The circuit breaker 2' includes the battery compartment 12 with the battery 16, the communications port 14, and a rating plug compartment 92 with a rating plug 94. The battery compartment 12 and the communications port 14 are accessible through the aperture 10 on the front face 8 of the circuit breaker 2'. The rating plug compartment 92 and the rating plug 94 are accessible through a second aperture 96 on the front face 8 of the circuit breaker 2'.

The cover 24" covers the apertures 10,96 and the rating plug 94. The cover 26' includes a guide plug 98 with a recess (not shown) for the rating plug 94. Removal of the cover 24" uncovers, but does not remove, the rating plug 94. In this manner, an operator may remove the cover 24" and utilize the communications port 14 without changing or modifying the rating plug 94. The cover 24" also has a nameplate 56' which includes, for example, identification of the requirements of the covered battery 16, the location of the communications port 14, and the requirements of the rating plug 94.

The exemplary connector covers 24,24',24" of FIGS. 1, 7 and 8 provide mechanisms for protecting the battery compartment 12 and communications port 14 from dust, dirt and ESD. Furthermore, the cover 24' includes the frangible locking mechanism 76 which provides a visual confirmation that the communications port 14 has remained covered and that there has been no unauthorized usage of the port 14. Moreover, the cover 24" provides mechanisms for protecting the rating plug 94 from dust, dirt and ESD. Those skilled in the art will appreciate that use of the frangible locking mechanism 76 with the cover 24" provides a visual confirmation that the rating plug 94 has remained covered and that there has been no unauthorized modification thereof.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A cover for a communications port and an aperture at a surface of an electrical switching device, the communications port having a recess having a shoulder, said cover comprising:

cover means with an opening for covering at least the communications port and the aperture; and plug means having a proximate end attached to said cover means and having a distal end for insertion within the recess of the communications port, said plug means including latch means connected to the distal end of said plug means having a detent insertable into the recess of the communications port in order to engage the shoulder of the recess and secure said cover means to the communications port, the latch means being a leaf spring means having a fixed end cantilevered from the distal end of said plug means and having a free end which protrudes through the opening of said cover means, the free end of the leaf spring means being movable toward said plug means in order to disengage the detent of said plug means from the shoulder of the recess of the communications port, said cover means including frangible locking means for holding the leaf spring means away from said plug means in order to prevent disengagement of the detent of said plug means from the shoulder of the recess of the communications port, the frangible locking means being adjacent the opening of said cover means and passing around the leaf spring means for holding the leaf spring means, and being breakable in order to permit disengagement of the detent of said plug means from the shoulder of the recess of the communications port.

2. The cover as recited in claim 1 wherein the frangible locking means includes a transverse wall having two holes and also includes a wire which passes through the two holes of the transverse wall and around the leaf spring means, the wire having two ends which are secured together in order to hold the leaf spring means away from said plug means.

3. An electrical switching device, comprising:

separable contact means;

a housing for said separable contact means including a surface having an aperture and a communications port with a recess;

cover means for covering at least the communications port and the aperture; and plug means having a proximate end attached to said cover means and having a distal end for insertion within the recess of the communications port, the recess of the communications port having a shoulder, said plug means includes latch means connected to the distal end of said plug means having a detent insertable into the recess of the communications port in order to engage the shoulder of the recess and secure said cover means to the communications port, said cover means having an opening, the latch means being a leaf spring means having a fixed end cantilevered from the distal end of said plug means and having a free end which protrudes through the opening of said cover means, the free end of the leaf spring means being movable toward said plug means in order to disengage the detent of said plug means from the shoulder of the recess of the communications port, said cover means including frangible locking means for holding the leaf spring means in order to prevent disengagement of the detent of said plug means from the shoulder of the recess of the communications port.

4. The electrical switching device as recited in claim 3 wherein the frangible locking means is adjacent the opening of said cover means, passes around the leaf spring means for holding the leaf spring means, and is breakable in order to permit disengagement of the detent of said plug means from the shoulder of the recess of the communications port.

5. The electrical switching device as recited in claim 4 wherein the frangible locking means includes a transverse wall having two holes and also includes a wire which passes through the two holes of the transverse wall and around the leaf spring means, the wire having two ends which are secured together in order to hold the leaf spring means away from said plug means.

6. The electrical switching device as recited in claim 3 wherein said housing also includes a battery compartment which is accessible through the aperture; wherein said cover means has a first portion and a second portion; wherein the first portion covers the battery compartment and the aperture; and wherein the opening of said cover means is in the second portion which is attached to said plug means.

7. The electrical switching device as recited in claim 6 wherein the battery compartment holds a battery; and wherein the first portion of said cover means includes means for retaining the battery within the battery compartment.

8. The electrical switching device as recited in claim 7 wherein the means for retaining the battery is a flange connected to the first portion of said cover means, the flange being generally perpendicular with respect to the first portion of said cover means.

9. The electrical switching device as recited in claim 8 wherein the battery compartment has two corners opposite from a wall which forms with the two corners a generally rectangular opening for the battery; wherein the first portion of said cover means has two posts for resting on the two corners and a transverse wall for resting on the wall of the battery compartment; and wherein the transverse wall of said cover means is generally transverse with respect to the flange of said cover means.

* * * * *